US010844707B2

(12) United States Patent
Garner et al.

(10) Patent No.: US 10,844,707 B2
(45) Date of Patent: Nov. 24, 2020

(54) DUAL TELEMETRIC COILED TUBING SYSTEM

(71) Applicant: Baker Hughes Incorporated, Houston, TX (US)

(72) Inventors: Louis D. Garner, Calgary (CA); Silviu Livescu, Calgary (CA); Thomas J. Watkins, Calgary (CA)

(73) Assignee: BAKER HUGHES INCORPORATED, Houston, TX (US)

( * ) Notice: Subject to any disclaimer, the term of this patent is extended or adjusted under 35 U.S.C. 154(b) by 7 days.

(21) Appl. No.: 16/344,210

(22) PCT Filed: Nov. 8, 2016

(86) PCT No.: PCT/US2016/060998

§ 371 (c)(1),
(2) Date: Apr. 23, 2019

(87) PCT Pub. No.: WO2018/088994

PCT Pub. Date: May 17, 2018

(65) Prior Publication Data

US 2019/0257194 A1 Aug. 22, 2019

(51) Int. Cl.
*E21B 47/12* (2012.01)
*E21B 17/20* (2006.01)

(52) U.S. Cl.
CPC ..... *E21B 47/12* (2013.01); *E21B 17/203* (2013.01); *E21B 17/206* (2013.01)

(58) Field of Classification Search
CPC ..... E21B 47/12; E21B 17/203; E21B 17/206; E21B 47/135
See application file for complete search history.

(56) References Cited

U.S. PATENT DOCUMENTS

2005/0263281 A1 12/2005 Lovell et al.
2012/0013893 A1 1/2012 Maida et al.
2014/0231066 A1* 8/2014 McColpin ..... E21B 47/06 166/66
2016/0146662 A1* 5/2016 Stokely ..... G01D 5/35361 73/643
2017/0096892 A1* 4/2017 Segura Dominguez ..... E21B 17/206

* cited by examiner

*Primary Examiner* — Brad Harcourt
(74) *Attorney, Agent, or Firm* — Shawn Hunter

(57) ABSTRACT

A dual telemetric coiled tubing running string for disposing a bottom hole assembly into a wellbore. The dual telemetric coiled tubing running string includes a string of coiled tubing which defines a flowbore along its length, an electrical wire conduit disposed within the flowbore, and an optic fiber disposed within the flowbore.

16 Claims, 3 Drawing Sheets

DUAL TELEMETRIC COILED TUBING SYSTEM

BACKGROUND OF THE INVENTION

1. Field of the Invention

The invention relates generally to systems and methods for transmitting power and data through a coiled tubing string.

2. Description of the Related Art

Coiled tubing is commonly used as a running string for a wide variety of downhole tools. Telecoil® is sometimes used to transmit power and data through coiled tubing. Telecoil is coiled tubing which includes tubewire within coiled tubing. Tubewire is a tube that contains an insulated cable that is used to provide electrical power and/or data to a bottom hole assembly (BHA) or to transmit data from the BHA to the surface. Tube-wire is available commercially from manufacturers such as Canada Tech Corporation of Calgary, Canada.

SUMMARY OF THE INVENTION

The present invention relates to systems and methods for transmitting electrical power and/or signals as well as optical signals within coiled tubing and along a wellbore.
A coiled tubing system is described which includes a string of coiled tubing which defines a central flowbore along its length. An electrical wire conduit and an optic fiber are disposed within the flowbore. In certain embodiments, the electrical wire conduit and optic fiber are enclosed within an outer protective tube within the flowbore. In preferred embodiments, the electrical wire conduit and optic fiber are first enclosed within an outer tube to form a tube assembly. The tube assembly is then inserted into a string of coiled tubing.

A coiled tubing system constructed in accordance with the present invention allows for bottom hole assemblies to be deployed which incorporate one or more sensors, which can detect one or more first downhole operating parameters, including depth, pressure, temperature, gamma and the like. Electrical power is transferred along the electrical wire conduit to the one or more sensors. In addition, the coiled tubing system affords the advantage of being able to sense a second downhole operating parameter, such as temperature or acoustic information, along the length of the coiled tubing string during operation.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
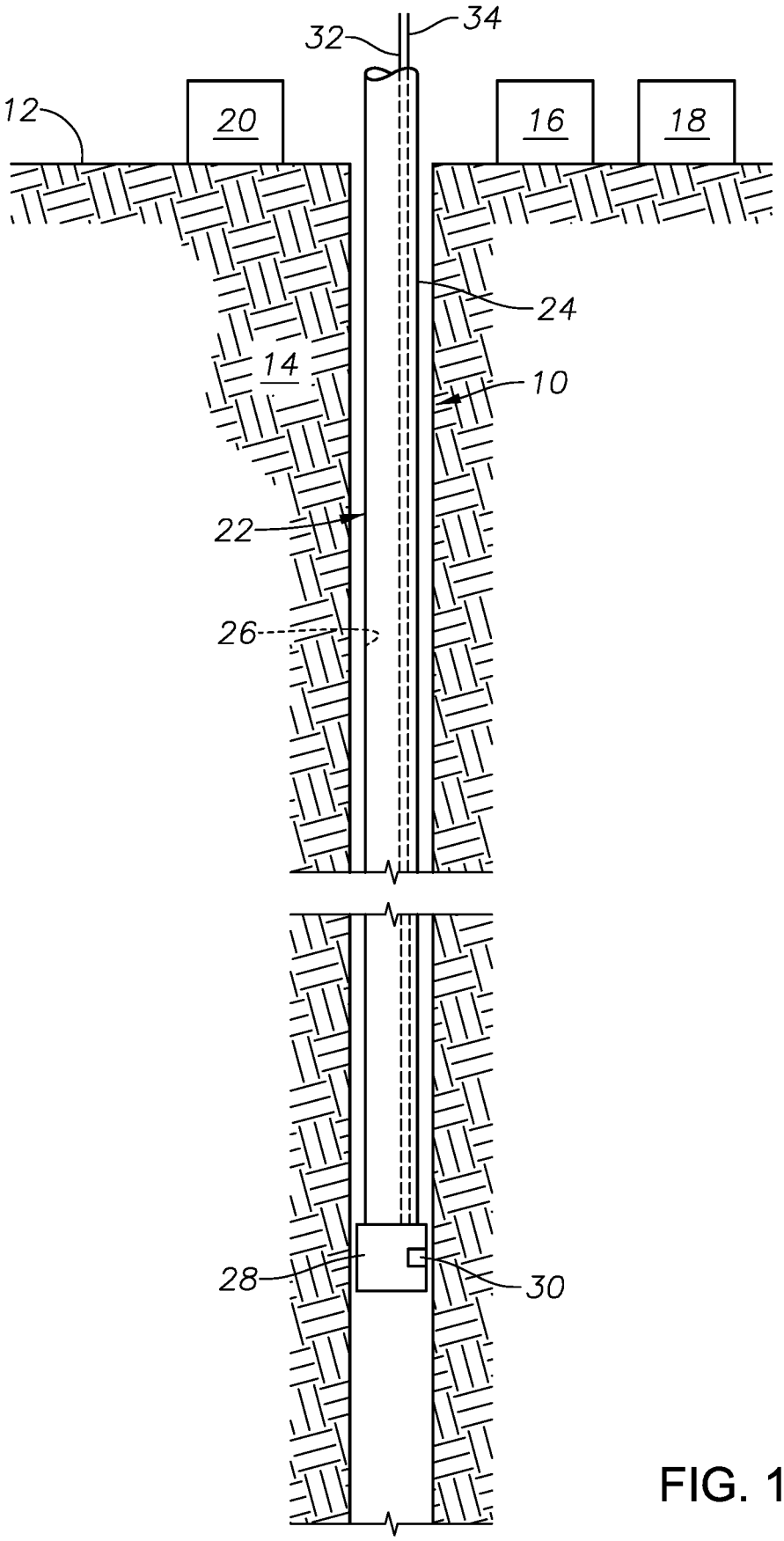
FIG. 1 is a side, cross-sectional view of an exemplary wellbore which contains a work string having a running string which incorporates dual telemetric power and data transmission in accordance with the present invention.

FIG. 1 illustrates an exemplary wellbore 10 which has been drilled from the surface 12 through the earth 14. Although the depicted wellbore 10 is shown as being vertically oriented within the earth 14, it should be understood that the wellbore, or portions thereof, may be inclined or horizontal.

A coiled tubing injector (not shown) of a type known in the art is located at surface 12 and is used to inject coiled tubing into the wellbore 10. A controller 16 is also located at surface 12. The controller 16 is preferably a programmable device, such as a computer, which is capable of receiving data in the form of electrical signals from a downhole sensor arrangement for display to a user and/or for storage. Additionally, an electrical power source 18 is located at surface 12 and may be in the form of a generator or battery. The electrical power source 18 should be suitable for transmitting power downhole to a sensor. Also located at surface 12 is an OTDR (optical time-domain reflectometer) 20.

A coiled tubing-based work string, generally indicated at 22, is shown being injected into the wellbore 10. The work string 22 includes a dual telemetric coiled tubing running string 24 which defines a central flowbore 26 along its length.

A bottom hole assembly 28 (BHA) is located at the distal end of the coiled tubing running string 24. The bottom hole assembly 28 may be a fishing BHA, an acidizing/fracturing BHA, or a cleanout BHA. Alternatively, the bottom hole assembly 28 could be any electrically powered tool, such as an electric submersible pump or a tool for opening and closing sliding sleeves.

The bottom hole assembly 28 includes one or more sensors 30 to detect at least one first operating parameter associated with the wellbore 10. Exemplary operating parameters include wellbore temperature and pressure as well as measurements relating to depth, gamma and the like. Sensor(s) 30 may be placed on the exterior surface of the bottom hole assembly 28, as illustrated in FIG. 1. Alternatively, the sensor(s) 30 can be located on the exterior of the coiled tubing running string 24 or in other locations which are advantageous for detection of a selected downhole operating parameter.

Figure 2:
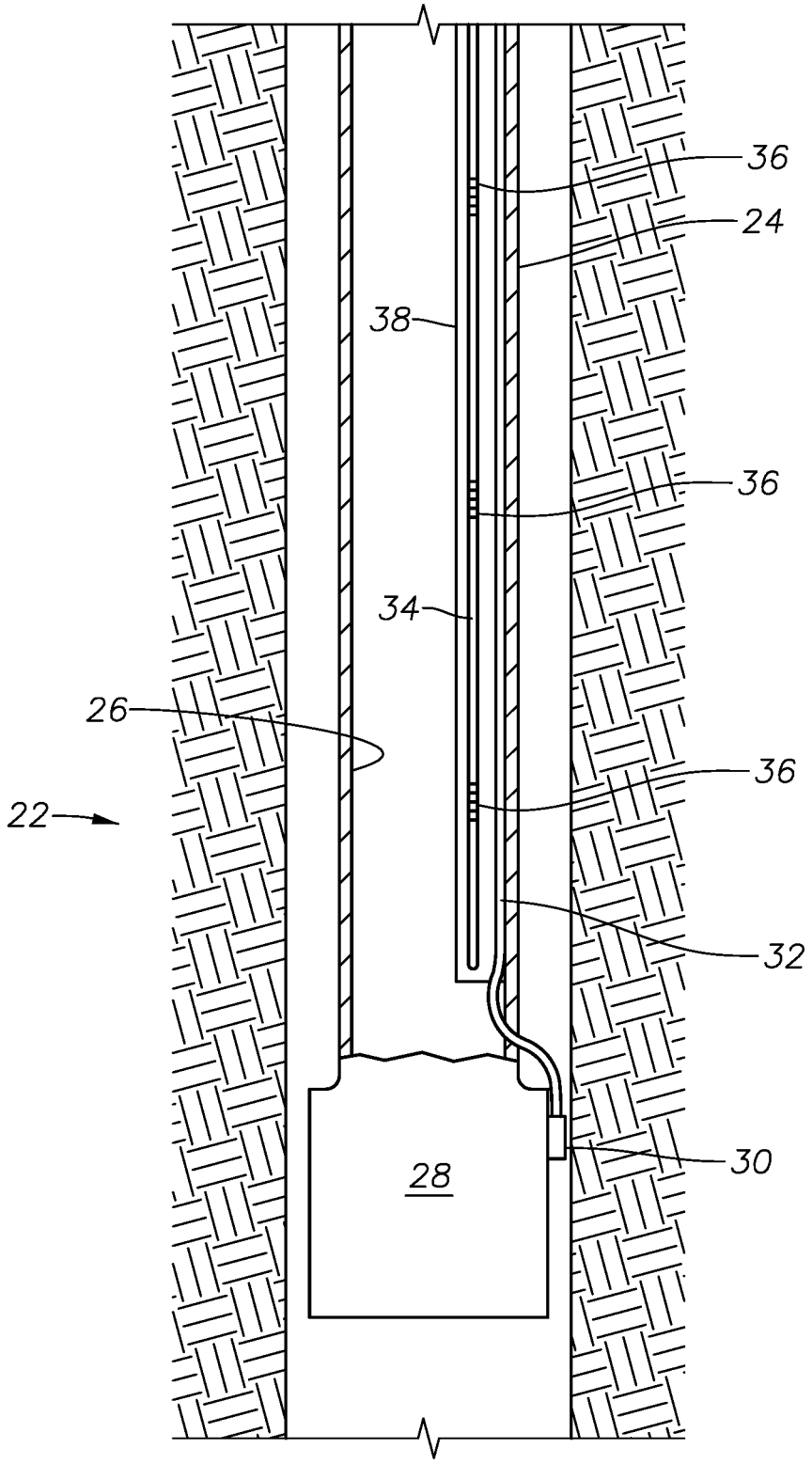
FIG. 2 is a side, cross-sectional view of an exemplary dual telemetric coiled tubing string in accordance with the present invention.
Figure 3:
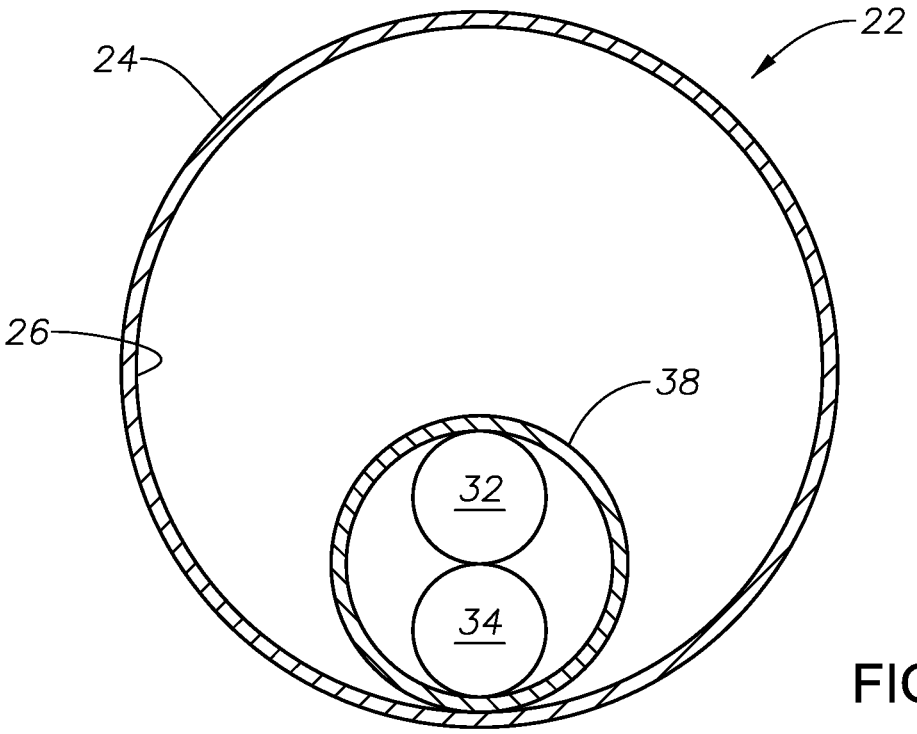
FIG. 3 is an axial cross-sectional view of the dual telemetric coiled tubing string of FIG. 2.

With further reference to FIGS. 2-3, an electrical wire conduit 32 and an optic fiber 34 are disposed within the flowbore 26 of the dual telemetric coiled tubing running string 24. In particular embodiments, the electrical wire conduit 32 is a 16-18 gauge stranded copper wire. The electrical wire conduit 32 preferably has a small diameter, on the order of about ⅛ inch. The electrical wire conduit 32 also functions as a data cable so that data representative of the parameters measured by the sensor(s) 30 can be transmitted to surface 12.

The optic fiber 34 will typically include a transparent central core with outer cladding which has a lower index of refraction than that of the core. The optic fiber 34 will include a number of Bragg gratings 36 (FIG. 2) along its length. In accordance with preferred embodiments, the Bragg gratings 36 are formed within the core of the optic fiber 34 at spaced intervals along the length of the fiber 34.

The OTDR 20 is operably associated with the optic fiber 34 and is used to both generate optical pulses into the optic fiber 34 as well as receive backscattered light from the optical fiber 34.

During operation of the work string 22, the optic fiber 34 provides optical telemetry to the OTDR 20 which is indicative of at least one second operating parameter within the wellbore 10. In certain embodiments, the optic fiber 34 and OTDR 20 are configured to perform distributed temperature sensing (DTS) or distributed acoustic sensing (DAS) and provide telemetry to the OTDR 20. The optic fiber 34 and OTDR 20 can provided information regarding sensed temperature or acoustics along the length of the optic fiber 34.

Figure 4:
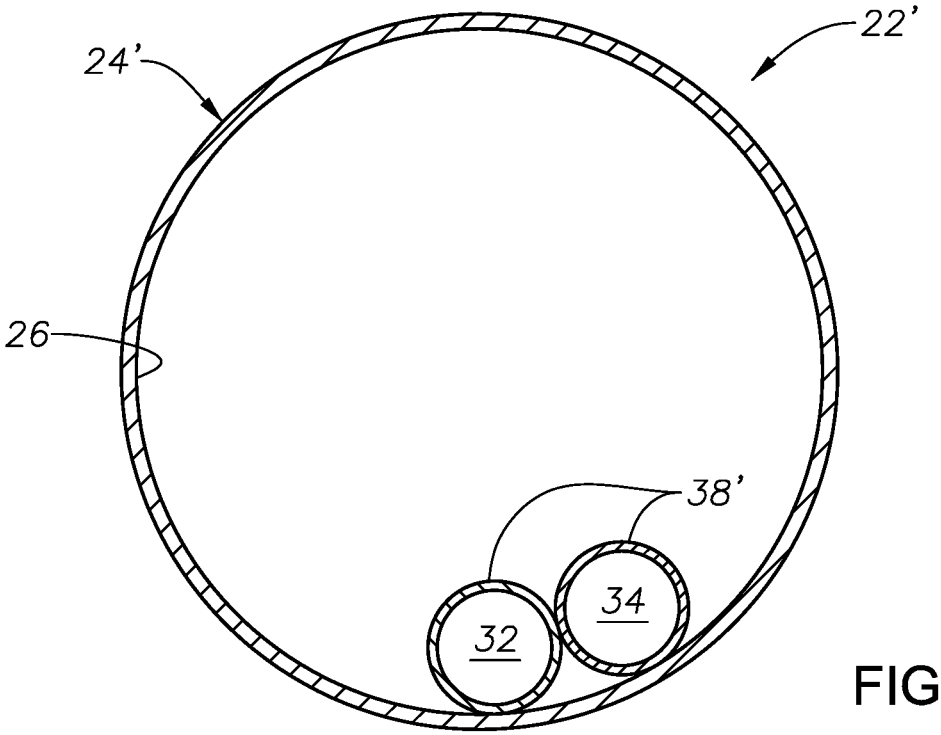
FIG. 4 is an axial cross-sectional view of an alternative embodiment for a dual telemetric coiled tubing string.

Preferably, either of both of the electrical wire conduit 32 and the optic fiber 34 are encased with a protective tube within the flowbore 26. FIG. 3 depicts an instance wherein both the electrical wire conduit 32 and the optic fiber 34 are encased within a single protective tube 38 within the flowbore 26. The inventors have found that this arrangement is advantageous since the dual telemetric coiled tubing running string 24 may be easily assembled by first encasing the electric wire conduit 32 and the optic fiber 34 and then inserting that arrangement into the flowbore 26 of the coiled tubing 24. The protective tube 38 is substantially rigid and strong enough to protect the encased electric wire conduit 32 or optic fiber 34 from damage due to fluid pressure and/or debris which might be passing through the flowbore 26. In a preferred embodiment, the protective tube 38 is formed of an Inconel alloy. FIG. 4 illustrates an alternative embodiment for a dual telemetric coiled tubing running string 24' wherein the electric wire conduit 32 and the optic fiber 34 are each individually encased within a separate protective tube 38'.

The electric wire conduit 32 is operably connected with the sensor(s) 30 downhole and with the controller 16 and electrical power source 18 at surface 12. Although depicted in the drawing as separate components, it should be understood that the controller 16 and power source 18 may be combined such that the controller 16 functions as a power source as well. In alternative embodiments, the power source 30 at surface may be supplemented by downhole batteries. The sensor(s) 30 provide sensed data to the controller 16 at surface 12.

In an exemplary operation, the coiled tubing running string 24/24' allows for dual telemetry transmission to occur. First, information from the optic fiber 34 is provided to the OTDR 20 which is indicative of a first downhole operating parameter (i.e., temperature or acoustic) within the flowbore 26. Second, information from sensor(s) 30 is transmitted which is representative of at least one second downhole operating parameter in the vicinity of the bottom hole assembly 28. Having access to both data from the optic fiber 34 and the downhole sensor(s) 30 allows combination of DTS/DAS methods with Telecoil. For instance, DTS could be used for flow profiling along the entire length of the coiled tubing running string 24 or 24', while the data from sensor(s) 30 could be used for accurate depth measurement or for DTS calibration. If the sensor(s) 30 include temperature sensor(s), these could be in direct contact with well fluids to measure well fluid temperature. Because the optic fiber 34 is located within the flowbore 26, it is not in direct contact with the well fluid that is located outside of the coiled tubing running string 24/24'. Thus, any temperature measurements provided by the optic fiber 34 are "static," meaning that the coiled tubing running string needs to be stationary within the wellbore in order for temperature changes in the well fluid to be measured by the optic fiber 34. With data from both the optic fiber 34 and the sensor(s) 30, the work string 22 could be moved, and any temperature changes sensed by the optic fiber 34 would be qualitative, meaning that the optic fiber 34 could indicate the locations within the wellbore 10 where the well fluid temperature is changing, further indicating the locations of fluid flow.

Those of skill in the art will recognize that numerous modifications and changes may be made to the exemplary designs and embodiments described herein and that the invention is limited only by the claims that follow and any equivalents thereof.

What is claimed is:

1. A dual telemetric coiled tubing running string for disposing a bottom hole assembly which is at least one of the group consisting of: a fishing bottom hole assembly, an acidizing/fracturing bottom hole assembly, a cleanout bottom hole assembly or an electrically powered tool into a wellbore, the dual telemetric coiled tubing running string comprising:

a string of coiled tubing which defines a flowbore along its length;

an electrical wire conduit disposed within the flowbore; and an optic fiber disposed within the flowbore and terminating above the bottom hole assembly, the optic fiber not being connected to a sensor at point of termination.

2. The dual telemetric coiled tubing running string of claim 1 wherein the electrical wire conduit is encased within a protective tube within the flowbore.

3. The dual telemetric coiled tubing running string of claim 1 wherein the optic fiber is encased within a protective tube within the flowbore.

4. The dual telemetric coiled tubing running string of claim 3 wherein the optic fiber is operably associated with an optical time-domain reflectometer to receive optical telemetry from the optic fiber which is representative of a detected second operating parameter within the flowbore.

5. The dual telemetric coiled tubing running string of claim 4 wherein the second operating parameter is a parameter from the group consisting of: temperature and acoustic.

6. The dual telemetric coiled tubing running string of claim 1 wherein the electrical wire conduit is operably associated with a sensor within the wellbore and transmits a signal representative of a first operating parameter sensed by the sensor.

7. The dual telemetric coiled tubing running string of claim 6 wherein the first operating parameter is a parameter from the group consisting of: temperature, pressure, depth and gamma.

8. The dual telemetric coiled tubing running string of claim 1 wherein the electrical wire conduit and the optic fiber are each individually encased within a separate protective tube.

9. A work string to be disposed within a wellbore, the work string comprising:

a bottom hole assembly which is at least one of the group consisting of: a fishing bottom hole assembly, an acidizing/fracturing bottom hole assembly, a cleanout bottom hole assembly or an electrically powered tool;

a dual telemetric coiled tubing running string for disposing a bottom hole assembly into a wellbore, the dual telemetric coiled tubing running string having:

a string of coiled tubing which defines a flowbore along its length;

an electrical wire conduit disposed within the flowbore; and an optic fiber disposed within the flowbore and terminating above the bottom hole assembly, the optic fiber not being connected to a sensor at point of termination.

10. The work string of claim 9 wherein the electrical wire conduit is encased within a protective tube within the flowbore.

11. The work string of claim 9 wherein the optic fiber is encased within a protective tube within the flowbore.

12. The work string of claim 9 wherein the electrical wire conduit is operably associated with a sensor within the wellbore and transmits a signal representative of a first operating parameter sensed by the sensor.

13. The work string of claim 12 wherein the first operating parameter is a parameter from the group consisting of: temperature, pressure, depth and gamma.

14. The work string of claim 9 wherein the optic fiber is operably associated with an optical time-domain reflectometer to receive optical telemetry from the optic fiber which is representative of a detected second operating parameter within the flowbore.

15. The work string of claim 14 wherein the second operating parameter is a parameter from the group consisting of: temperature and acoustic.

16. The work string of claim 9 wherein the electrical wire conduit and the optic fiber are each individually encased within a separate protective tube.

* * * * *